US005246341A

United States Patent [19]

Hall et al.

[11] Patent Number: 5,246,341

[45] Date of Patent: Sep. 21, 1993

[54] TURBINE BLADE TRAILING EDGE COOLING CONSTRUCTION

[75] Inventors: Kenneth B. Hall, Jupiter; Thomas A. Auxier, Palm Beach Gardens, both of Fla.

[73] Assignee: United Technologies Corporation, Hartford, Conn.

[21] Appl. No.: 909,471

[22] Filed: Jul. 6, 1992

[51] Int. Cl.[5] ..... F01D 5/18

[52] U.S. Cl. ..... 416/97 R

[58] Field of Search ..... 415/115, 116; 416/96 R, 416/96 A, 97 R

[56] References Cited

U.S. PATENT DOCUMENTS 3,799,696 3/1974 Redman ..... 415/115

4,775,296 10/1988 Schwarzmann et al. ..... 415/115

4,786,233 11/1988 Shizuya et al. ..... 416/96 R

FOREIGN PATENT DOCUMENTS 2346341 3/1974 Fed. Rep. of Germany .... 416/97 R 0135606 7/1985 Japan ..... 416/97 R 0358525 1/1973 U.S.S.R. ..... 416/96 R

*Primary Examiner*—Edward K. Look

*Assistant Examiner*—Christopher Verdier

*Attorney, Agent, or Firm*—Norman Friedland

[57] ABSTRACT

Internal cooling of the trailing edge of the airfoil of the turbine blade for a gas turbine engine includes a cascade formed from juxtaposed rows of longitudinally extending spaced airfoil shaped vanes or ribs leading cooling air from a supply source through the space between adjacent vanes and discharging out of the blade.

3 Claims, 2 Drawing Sheets

TURBINE BLADE TRAILING EDGE COOLING CONSTRUCTION

TECHNICAL FIELD

This invention relates to turbine blades for gas turbine engines and particularly to means for cooling the trailing edge of the airfoil.

BACKGROUND ART

As is well known in the gas turbine engine art, it is abundantly important to utilize engine cooling air in the most expeditious manner inasmuch as its use results in a penalty in engine performance. Hence, to minimize its use and maximize engine performance, it becomes paramount that designers of gas turbine engines obtain the maximum cooling effectiveness with minimum pressure drop requirements and cooling air flow rates.

Cooled turbine blades of the type that flows air internally typically bleed air from the engine's compressor section into three major portions: the trailing edge, the leading edge, and the middle section therebetween. Inasmuch as this invention deals solely with the trailing edge, for the sake of simplicity and convenience, only the trailing edge will be considered and described herein. Specifically, the trailing edge as considered herein is that portion of the airfoil that is aft of the passage channeling the cooling air up from the root of the blade.

Historically, trailing edges of airfoils have heretofore been cooled using combinations of features such as pedestals, impingement rows, slots, trip strips and dimples. An understanding of the prior art can be had by referring to the turbine blade depicted in FIGS. 1 and 2.

The cooling air flowing up the supply passage 10 is bled through a row of impingement holes 12. Then the air, now flowing in a primarily axial direction with respect to the engine centerline, is bled through a second row of impingement holes 13. Obviously, total pressure of the cooling air is reduced across each row of impingement holes. At the same time that coolant pressure is being reduced, external gaspath pressure in which the turbine is operating is also declining as the gas accelerates in the converging airfoil passages 14. Coolant pressure in the internal passages is always maintained at a higher level of pressure than external gaspath pressure to ensure the ability to insert film cooling holes into the passages, or to ensure outflow of coolant in the event a crack is created through the wall. The chambers directly behind the impingement rows allow radial flow, preventing local blockages due to imperfect castings or foreign material from causing an extended hot streak all the way to the trailing edge. After passing through the second row of impingement holes and collecting in the second chamber 15, the cooling air enters slots 16 which conduct the air to discharge ports 17 on the concave side of the airfoil just forward of the extreme trailing edge 18. As the air passes through these impingement rows and slots, high levels of heat transfer are generated on the internal walls due to boundary layer disturbances created by impingement and entrances.

Alternative geometries to the one described above are commonly in use Specific applications dictate in many instances the types of features which provide the most advantage. Certain applications call for multiple rows of pedestals which provide good heat transfer with lower pressure drop than impingement rows. Trip strips of various shapes and sizes are commonly used in conjunction with impingement rows and pedestals, with and without slots. All these approaches are similar in that they augment heat transfer coefficients and surface area through a series of contractions, moving the flow in the axial direction, while allowing radial communication.

Typically, flow through the trailing edge is restricted as much as possible while still providing uniform cooling in the radial direction. Restriction is limited by the minimum allowable passage size, which is determined by producibility considerations. Small passages are created by small, fragile core features in the investment casting method now used almost exclusively in the manufacture of cooled turbine airfoils. When passages are driven to too small a size to restrict flow, they are prone to breakage due to handling and stresses induced during the manufacturing process.

We have found that we can enhance cooling effectiveness without increasing flow levels and without the utilization of the heat transfer enhancement techniques described immediately above. This invention contemplates utilizing a cascade formed of rows of staggered turning vanes or ribs. Not only does this inventive concept afford a high cooling effectiveness at a given cooling flow level, it also provides improved producibility in the manufacturing of turbine blades made in production.

SUMMARY OF THE INVENTION

An object of this invention is to provide an improved cooling of the trailing edge of the airfoil section of a turbine blade for a gas turbine engine.

A feature of this invention is to provide a cascade of rows of staggered turning vanes or ribs at the trailing edge.

A feature of this invention is to provide a turbine blade trailing edge cooling scheme that is characterized as more reproducible than heretofore known cooling enhancement schemes.

The foregoing and other features and advantages of the present invention will become more apparent from the following description and accompanying drawings.

BEST MODE FOR CARRYING OUT THE INVENTION

Figure 1:
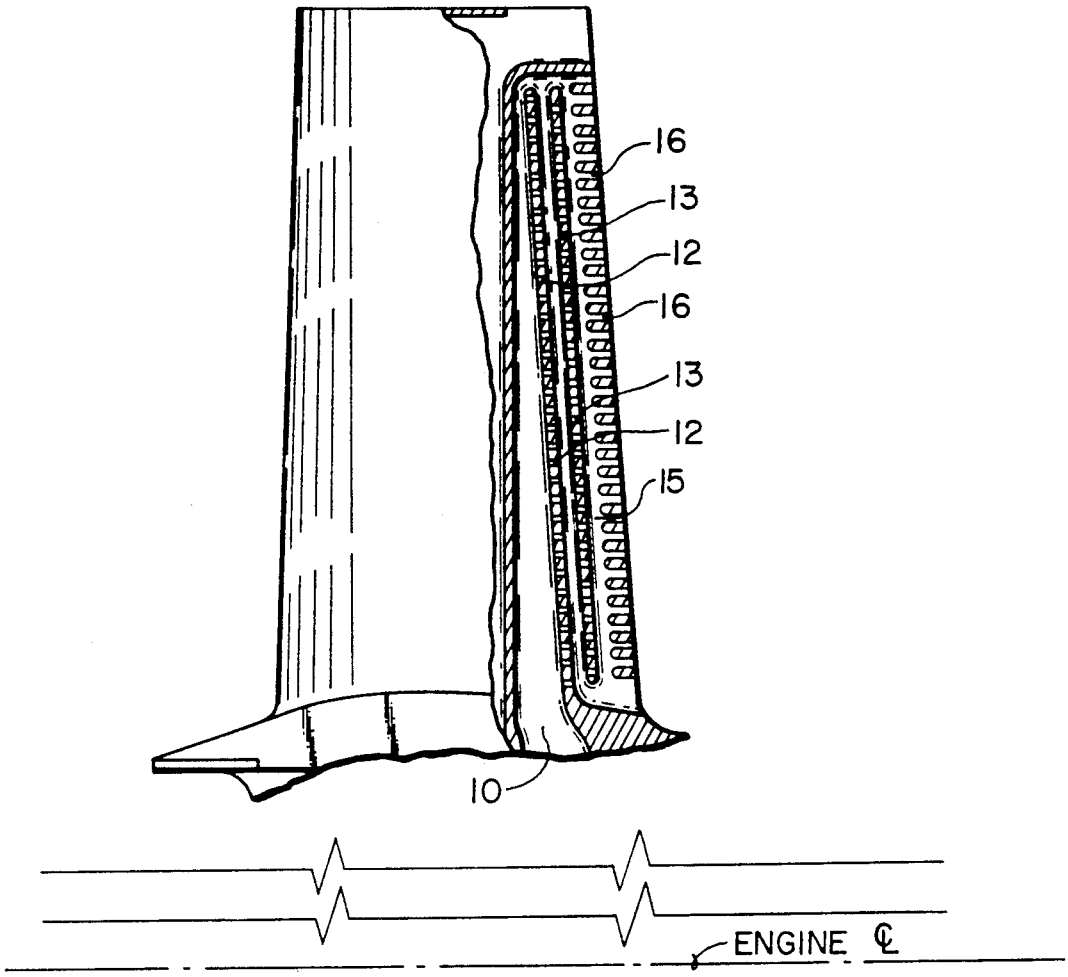
FIG. 1 is a plan partial view in elevation partly in section of a prior art turbine blade depicting the trailing edge.
Figure 2:
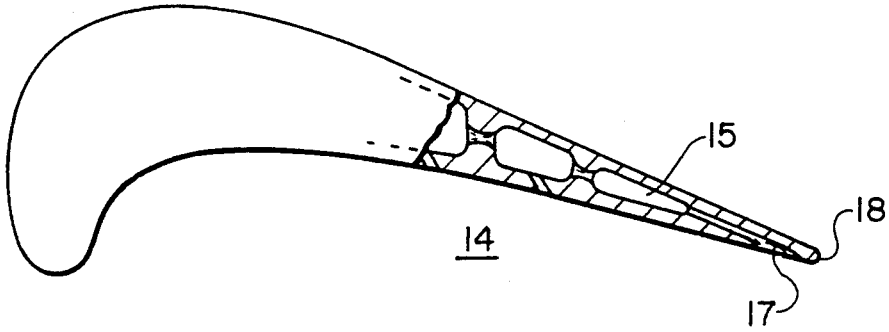
FIG. 2 is a view partly in section and partly in full view of FIG. 1.
Figure 3:
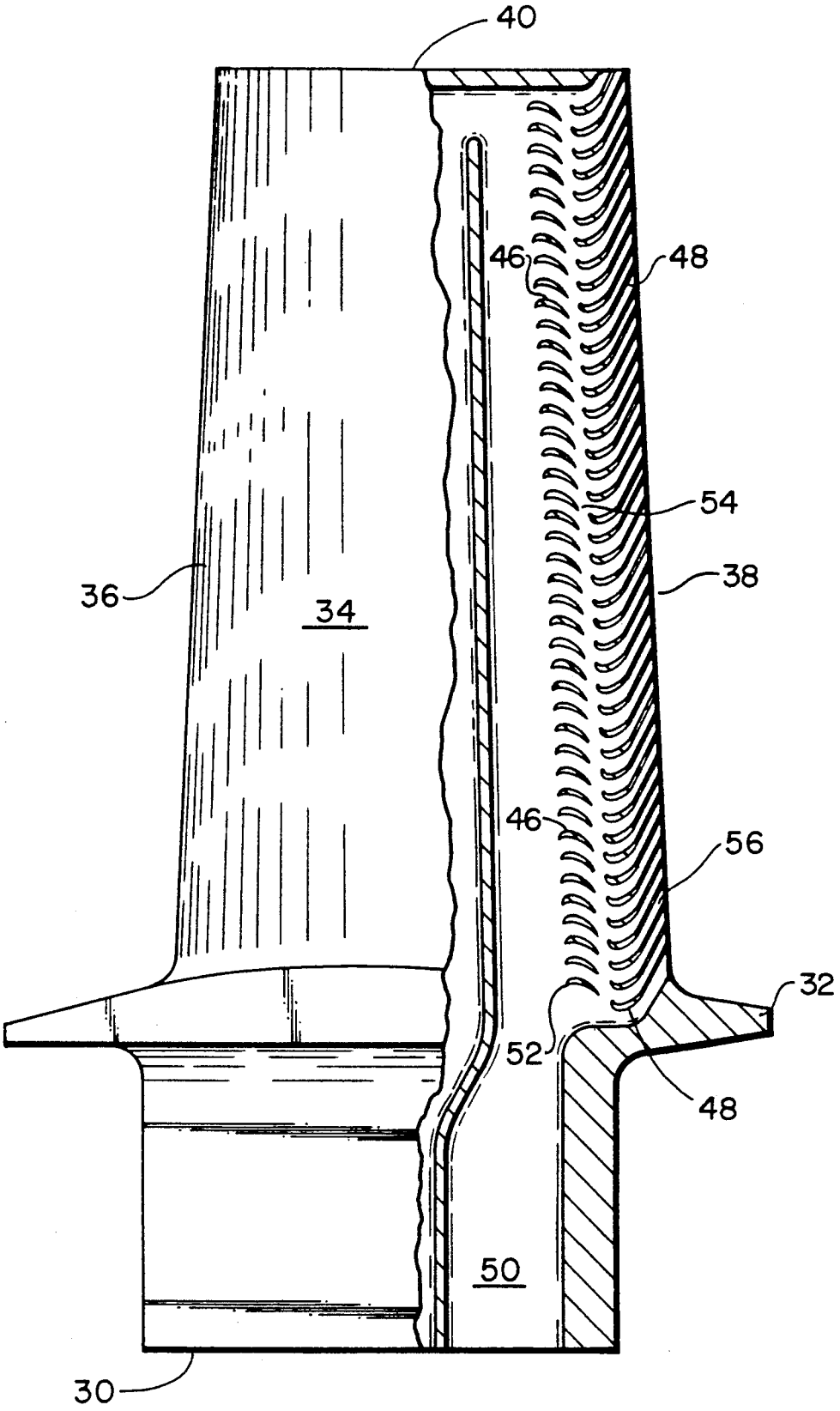
FIG. 3 is an elevation view depicting a turbine blade similar to the blade in FIG. 1 including a partial sectional view illustrating the invention in detail.

The invention can be best understood by referring to FIG. 3, which shows the blade of a turbine rotor for a gas turbine engine having a root section 30, a platform 32 and an airfoil section 34. The airfoil section 34 and root section 30 are hollow and consists of a plurality of internal passages feeding cooling systems for cooling the leading edge 36, trailing edge 38, tip section 40, and the portion intermediate the trailing edge 38 and leading edge 36. Cooling air also flows through a plurality of film cooling holes (not shown) to lay a layer of cooling air over the surface of the blade on the pressure side and suction side.

As mentioned above, since the invention pertains to the trailing edge, only that portion of the blade will be considered. As shown in FIG. 3 and in accordance with this invention, a cascade is formed by two rows of longitudinally extending vanes or ribs 46 and 48 respectively. Air from the compressor (not shown) enters the cascade through the root section 30 feeding the longitudinal passage 50. The leading edges 52 of the airfoil-shaped ribs 46 are turned down relative to the root section to capture some of the total pressure available in longitudinal passage 50. The extra pressure is now available to promote additional heat transfer through increased velocity. Curving the front rib also eliminates the tendency for cooling flow separating from the rib as it turns from radial to axial direction, as is often observed in heretofore known designs. The air is accelerated and turned through the converging passage between ribs 46. After exiting the first row of the cascade, cooling air is picked up by the next row 48, which is oriented so as to capture the total pressure of the cooling in the longitudinal space 54. After the second row again turns and accelerates the flow, it is ejected at high velocity through the discharge ports 56. It then proceeds towards the extreme trailing edge 38 at an acute radial angle.

By moving the flow at an acute angle to the axial direction, more channel length is created through which the flow must travel before it is discharged. Convective heat transfer is increased due to increased convective area. Secondary flows set up within the passages due to the turning further enhances heat transfer. Use of two sets of cascade ribs with a space in between preserves the ability of flow to go around local blockages, and prevents buildup of pressure potential which could lead to separations. This increase in height will improve producibility by increasing core stiffness. By orienting the last row in the cascade radially outward where the flow is discharged onto the concave surface, the tendency for conventional designs to build up foreign material on the inner surface after the exit will be reduced.

The scope of this invention contemplates variations in the number of rows in the cascade, as well as size, shape, and angle of the vanes, and surface treatments such as texturing can be used to tailor this concept for particular applications. It is also within the scope of the invention to use other heat transfer enhancement means such as the impingement rib in conjunction with the cascade.

Although this invention has been shown and described with respect to detailed embodiments thereof, it will be understood by those skilled in the art that various changes in form and detail thereof may be made without departing from the spirit and scope of the claimed invention.

We claim:

1. An airfoil of a hollow turbine blade including a trailing edge comprising a first row of airfoil shaped vanes extending longitudinally internally of said airfoil, a second row of airfoil shaped vanes extending longitudinally internally of said airfoil and adjacent said trailing edge and being juxtaposed relative to said first row of airfoil shaped vanes, and passageways internally of said airfoil for leading cooling air from a source through a longitudinal passageway and laterally in a cascaded manner through the spaces between adjacent vanes in said first row or airfoil shaped vanes, through a second longitudinal passageway, through spaces between adjacent vanes in said second row of airfoil vanes to discharge out of the trailing edge of said airfoil through discharge ports formed in said airfoil.

2. An airfoil as claimed in claim 1 wherein said turbine blade includes a root portion and a tip portion, wherein each of said vanes in said first row of vanes includes a leading edge and said leading edge is turned in a direction facing said root portion.

3. An airfoil as claimed in claim 2 wherein each of said vanes in said second row of vanes includes a trailing edge that is oriented in a direction facing the tip of said airfoil.

* * * * *